US012662811B2

(12) United States Patent
Torres et al.

(10) Patent No.: US 12,662,811 B2
(45) Date of Patent: Jun. 23, 2026

(54) FRAME BACKING PANEL

(71) Applicant: Stockton Products, North Las Vegas, NV (US)

(72) Inventors: Angelberto Torres, La Puente, CA (US); James Ellarbee Stafford, Oakley, CA (US)

(73) Assignee: STOCKTON PRODUCTS, Las Vegas, NV (US)

( * ) Notice: Subject to any disclaimer, the term of this patent is extended or adjusted under 35 U.S.C. 154(b) by 0 days.

(21) Appl. No.: 19/094,306

(22) Filed: Mar. 28, 2025

(65) Prior Publication Data

US 2025/0223798 A1 Jul. 10, 2025

Related U.S. Application Data

(63) Continuation of application No. 18/456,425, filed on Aug. 25, 2023, now abandoned.

(60) Provisional application No. 63/486,655, filed on Feb. 23, 2023.

(51) Int. Cl.

| | |
|---|---|
| ***E04B 2/58*** | (2006.01) |
| ***E04B 2/74*** | (2006.01) |
| ***E04B 2/76*** | (2006.01) |
| ***E04B 2/78*** | (2006.01) |
| *E04B 1/24* | (2006.01) |
| *E04C 3/04* | (2006.01) |

(52) U.S. Cl.

CPC ..... *E04B 2/58* (2013.01); *E04B 2/7457* (2013.01); *E04B 2/762* (2013.01); *E04B 2/765* (2013.01); *E04B 2/767* (2013.01); *E04B 2/789* (2013.01); *E04B 2001/2448* (2013.01); *E04B 2002/7485* (2013.01); *E04C 2003/0473* (2013.01)

(58) Field of Classification Search

CPC ..... E04B 2/58; E04B 2/7457; E04B 2/762; E04B 2/765; E04B 2/767; E04B 2/789; E04B 2001/2448; E04B 2002/7485; E04C 2003/0473

See application file for complete search history.

(56) References Cited

U.S. PATENT DOCUMENTS 5,189,857 A * 3/1993 Herren ..... E04C 3/02 52/317
5,692,341 A * 12/1997 Erlandson ..... F16B 12/02 52/36.5

(Continued)

FOREIGN PATENT DOCUMENTS

CA 2659794 A1 * 3/2010 ..... E04B 2/7457
WO WO-9833995 A1 * 8/1998 ..... E04B 2/7457
WO WO-0131134 A1 * 5/2001 ..... E04B 2/58

OTHER PUBLICATIONS

ClarkDietrich, Backer Bar, Pub. No. CD-ClipExpress 01/23, Jan. 27, 2023, 1 page.

(Continued)

*Primary Examiner* — Jessie T Fonseca
(74) *Attorney, Agent, or Firm* — Womble Bond Dickinson (US) LLP

(57) ABSTRACT

A backing panel includes a first stud interfacing portion for nesting in a first stud and a second stud interfacing portion for coupling with a second stud, such that a web surface of the backing panel is flush with a surface of the first stud and a surface of the second stud.

17 Claims, 11 Drawing Sheets

(56) References Cited

U.S. PATENT DOCUMENTS 6,260,318 B1 * 7/2001 Herren ..... E04B 2/7453 52/696
6,453,627 B1 * 9/2002 Powers ..... E04B 1/34342 52/745.1
7,520,100 B1 * 4/2009 Herrman ..... E04B 2/7457 52/27
2003/0074846 A1 * 4/2003 Tollenaar ..... E04B 2/7457 52/125.1
2008/0041001 A1 * 2/2008 Melton ..... E04F 21/1844 52/293.3
2008/0053013 A1 * 3/2008 Tollenaar ..... E04B 2/7457 52/212
2009/0217603 A1 * 9/2009 Brady ..... E04B 2/7457 52/745.05
2014/0165499 A1 * 6/2014 Vanker ..... E04C 3/07 29/897
2014/0290176 A1 * 10/2014 Rice ..... E04B 2/7457 52/696
2014/0305071 A1 * 10/2014 Belanger ..... E04B 2/7457 52/762
2015/0047288 A1 * 2/2015 Klein ..... E04B 2/02 52/655.1
2015/0082737 A1 * 3/2015 Brady ..... E04G 23/0222 52/698
2015/0113896 A1 * 4/2015 Pahlmann ..... E04B 2/7411 52/317
2015/0143770 A1 * 5/2015 Lin ..... E04B 2/7457 52/655.1
2017/0159284 A1 * 6/2017 Getz ..... E04B 2/58
2018/0094423 A1 * 4/2018 Getz ..... E04B 9/127
2019/0383007 A1 * 12/2019 Benefield ..... E04B 2/721
2022/0074199 A1 * 3/2022 Sessler ..... E04C 3/32

OTHER PUBLICATIONS

Safti-Seal®, Safti-Seal (FBR) Flush Backing Plate, Pricing—2022, Jan. 1, 2022, 1 page.
SCAFCO Steel Stud Company, NS—Notched Stud Backing, SCAFCO, Nov. 6, 2018, 1 page.
Thompson and La Brie, Structural Engineers, Pasadena, CA, Flush-Mount ADA Complaint Backing (pat# 5, 189,857), Sep. 25, 1997, 5 pages.
Website: "Product Profiles", Steeltec Supply, Inc., dated Mar. 8, 2015, 1 page, http://steeltecsupply.com/products/.

* cited by examiner

FRAME BACKING PANEL

CROSS-REFERENCE TO RELATED APPLICATION(S)

This application is a continuation of U.S. application Ser. No. 18/456,425, filed on Aug. 25, 2023, which is based upon and claims priority to U.S. Provisional Application No. 63/486,655, filed Feb. 23, 2023, the contents of all of which are fully incorporated herein by reference.

BACKGROUND OF THE INVENTION

Backing panels are mounted between studs for supporting a wall-defining board such a dry wall. Specifically, a first end of the backing panel is mounted to a first stud and a second end of the backing panel opposite the first end is mounted on second stud adjacent to the first stud. Current backing panels when mounted on adjacent studs are not flush with, or parallel to, the adjacent studs, thus not creating a planar flush surface from stud to stud for receiving the board or dry wall. Moreover, current backing panels are provided at preset lengths to be mounted on adjacent studs that are spaced apart by a predetermined distance. These backing panels, because of their preset lengths, are unusable if the spacing between adjacent studs is increased or decreased from the predetermined distance. In addition, backing panels are designed to be mounted between adjacent studs that are oriented in the same direction. As such, a first end portion of a backing panel that interfaces with the first stud has a first geometry and the second end portion of the backing panel interfacing with the second stud has a second geometry different from first geometry. Sometime adjacent studs are not oriented in the same direction and as such, existing backing panels cannot be used. Backing panels are desired that address these shortcomings of existing backing panels.

SUMMARY

An example embodiment backing panel includes a main body including a web, a first stud interfacing portion extending from one end of the main body for nesting within a first stud. The first stud interfacing portions includes a first leg extending perpendicularly from the web, a second leg extending distally and perpendicularly from the first leg, a third leg extending distally and perpendicularly from the second leg, a fourth leg extending distally and perpendicularly from the third leg for being adjacent to a leg of the first stud, and a fifth leg extending distally and perpendicularly from the fourth leg for being adjacent to a web of the first stud. The first, second and third legs define a channel. The backing panel also includes a second stud interfacing portion extending from an opposite end of the main body for coupling with a second stud. In another example embodiment, an outer surface of the main body web is parallel to an outer surface of the fourth leg, and the outer surface of the fourth leg is offset from the outer surface of the main body web by a predetermined distance. In yet another example embodiment, the predetermined distance is a thickness of a sheet of material forming the first stud. In a further example embodiment, the main body includes a first portion that is slideably coupled to a second portion. With this example embodiment, the first stud interfacing portion extends from the first portion of the main body, and the second stud interfacing portions extends from the second portion of the main body. In yet a further example embodiment, one of the main body first and second portions is received within the other of the main body first and second portions, and the other of the main body first and second portions retains the one of the body first and second portions laterally in relation to a direction of sliding of the main body first and second portions relative to each other. In one example embodiment, the main body includes a third portion coupling the first portion of the main body to the second portion of the main body by being slideably coupled to at least one of the first and second portion of the main body. In another example embodiment, the first portion of the main body includes a first portion of the main body web outer surface, the second portion of the main body includes a second portion of the main body web outer surface, and the first portion and second portion of the main body web outer surface are coplanar. In yet another example embodiment, the third portion is received within the first portion and the second portion of the main body and is retained laterally relative to the direction of relative sliding between the first and second portion by the first and second portions. In a further example embodiment, the second stud interfacing portion is a sixth leg extending perpendicularly from the main body web. In a further example embodiment, the second stud interfacing portion is a sixth leg extending at an angle greater than 90 degrees from the main body web. In one example embodiment, the second stud interfacing portion includes a sixth leg extending perpendicularly from the main body web, a seventh leg extending distally and perpendicularly from the sixth leg, an eighth leg extending distally and perpendicularly from the seventh leg, a ninth leg extending distally and perpendicularly from the eighth leg, and a tenth leg extending distally and perpendicularly from the ninth leg With this example embodiment, the sixth, seventh and eighth legs define a channel In yet another example embodiment, when coupled to the first and second studs, an outer surface of the main body web is flush with an outer surface of the first stud and an outer surface of the second stud.

In a further example embodiment, a backing panel includes a main body including a web, a first stud interfacing portion extending from one end of the main body for nesting within a first stud, a second stud interfacing portion extending from an opposite end of the main body for coupling with a second stud. The first stud interfacing portion includes a first leg extending coplanar from the web, a second leg extending distally and perpendicularly from the first leg, a third leg extending distally and perpendicularly from the second leg for being adjacent to a leg of the first stud, and a fourth leg extending distally and perpendicularly from the third leg for being adjacent to a web of the first stud. In yet a further example embodiment, an outer surface of the main body web is parallel to an outer surface of the third leg, and wherein the outer surface of the third leg is offset from the outer surface of the main body web by a predetermined distance. In one example embodiment, the main body includes a first portion that is slideably coupled to a second portion. With this example embodiment, the first stud interfacing portion extends from the first portion of the main body and the second stud interfacing portions extends from the second portion of the main body. In another example embodiment, one of the main body first and second portions is received within the other of the main body first and second portions, the other of the main body first and second portions retains the one of the body first and second portions laterally in relation to a direction of sliding of the main body first and second portions relative to each other. In yet another example embodiment, the main body includes a third portion coupling the first portion of the main body to the second portion of the main body by being slideably coupled to at least one of the first and second portion of the main body. In a further example embodiment, the first portion of the main body includes a first portion of the main body web outer surface, the second portion of the main body includes a second portion of the main body web outer surface, and the first portion and second portion of the main body web outer surface are coplanar. In yet a further example embodiment, the third portion is received within the first portion and the second portion of the main body and is retained laterally relative to the direction of relative sliding between the first and second portion by the first and second portions. In another example embodiment, the second stud interfacing portion is a fifth leg extending perpendicularly main body web. In yet another example embodiment, the second stud interfacing portion is a fifth leg extending at an angle greater than 90 degrees from the main body web. In a further example embodiment, the second stud interfacing portion includes, a fifth leg extending perpendicularly from the main body web, a sixth leg extending distally and perpendicularly from the fifth leg, a seventh leg extending distally and perpendicularly from the sixth leg, an eighth leg extending distally and perpendicularly from the seventh leg and a ninth leg extending distally and perpendicularly from the eighth leg. With this example embodiment, the fifth, sixth and seventh legs define a channel. In yet a further example embodiment, when coupled to the first and second studs, an outer surface of the main body web is flush with an outer surface of the first stud and an outer surface of the second stud.

In one example embodiment, a backing panel includes a main body including a web, a first stud interfacing portion extending from one end of the main body for coupling with a first stud, and a second stud interfacing portion extending from an opposite end of the main body for coupling with a second stud. The main body includes a first portion that is slideably coupled to a second portion. The first stud interfacing portion extends from the first portion of the main body and the second stud interfacing portion extends from the second portion of the main body. The first stud interfacing portion also includes a first leg extending transversely from the web, a second leg extending distally and transversely from the first leg, a third leg extending distally and transversely from the second leg, a fourth leg extending distally and transversely from the third leg, and a fifth leg extending distally and transversely from the fourth leg. With this example embodiment, the first, second and third legs define a channel. In another example embodiment, the main body includes a third portion coupling the first portion of the main body to the second portion of the main body by being slideably coupled to at least one of the first and second portion of the main body.

In a further example embodiment, a backing panel includes a main body including a web, a first stud interfacing portion extending from one end of the main body for nesting within a first stud, and a second stud interfacing portion extending from an opposite end of the main body for coupling with a second stud. With this example embodiment, the second stud interfacing portion has a leg extending from the web at an angle greater than 90 degrees. In yet a further example embodiment, when coupled to the first and second studs, an outer surface of the web is flush with an outer surface of the first stud and an outer surface of the second stud.

DETAILED DESCRIPTION

Figure 1A:
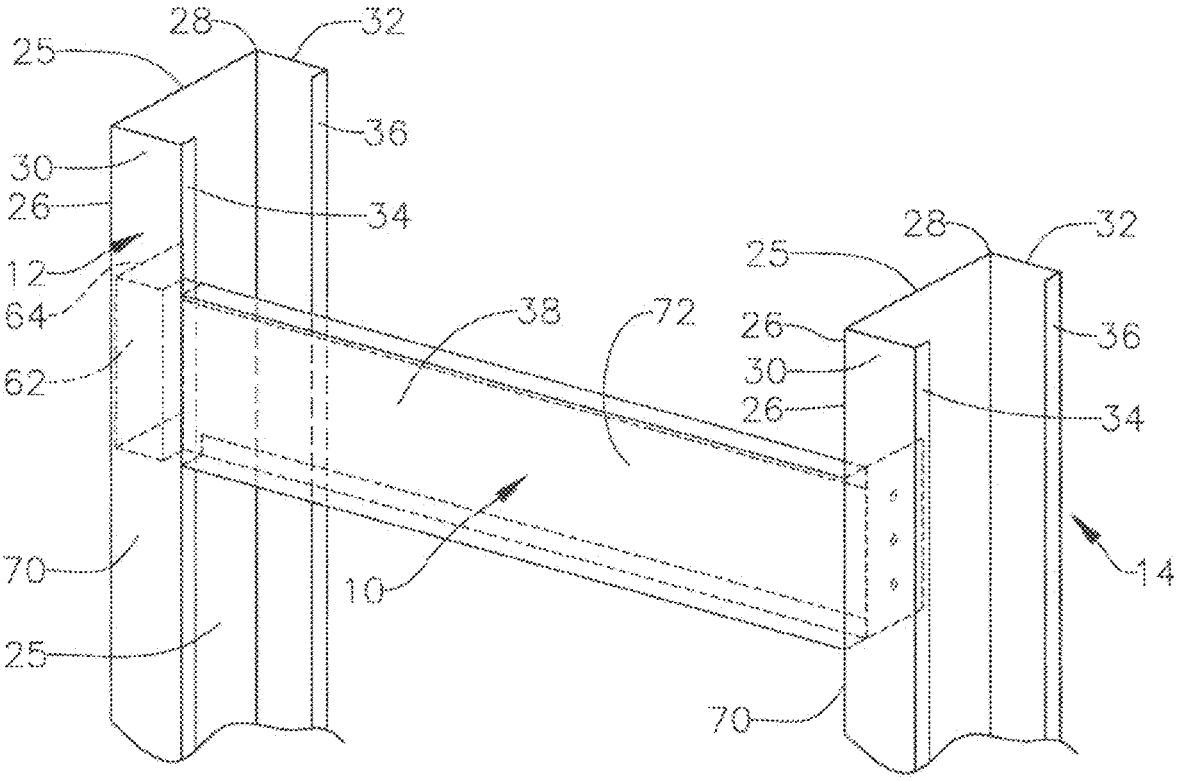
FIG. 1A is a perspective view of an example embodiment backing panel mounted on two adjacent studs.
Figure 1B:
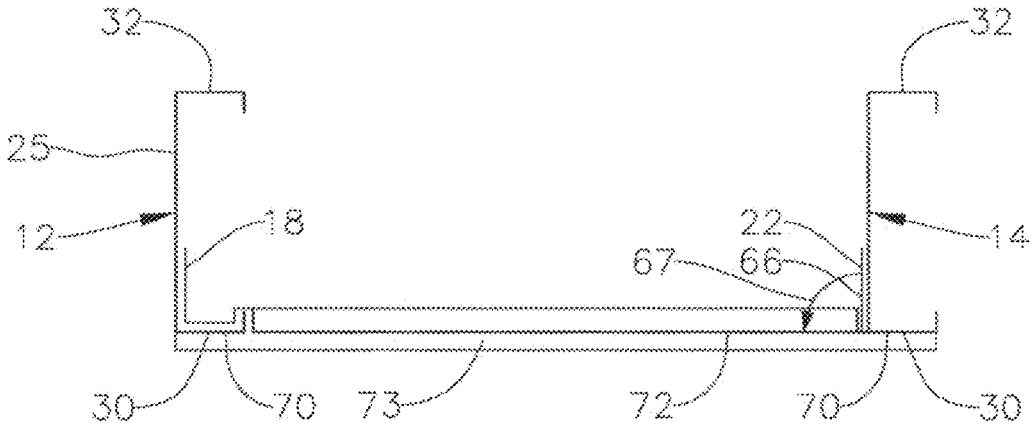
FIG. 1B is an end view of the backing panel mounted on two adjacent studs as shown in FIG. 1A with a wall-defining board mounted thereon.
Figure 2:
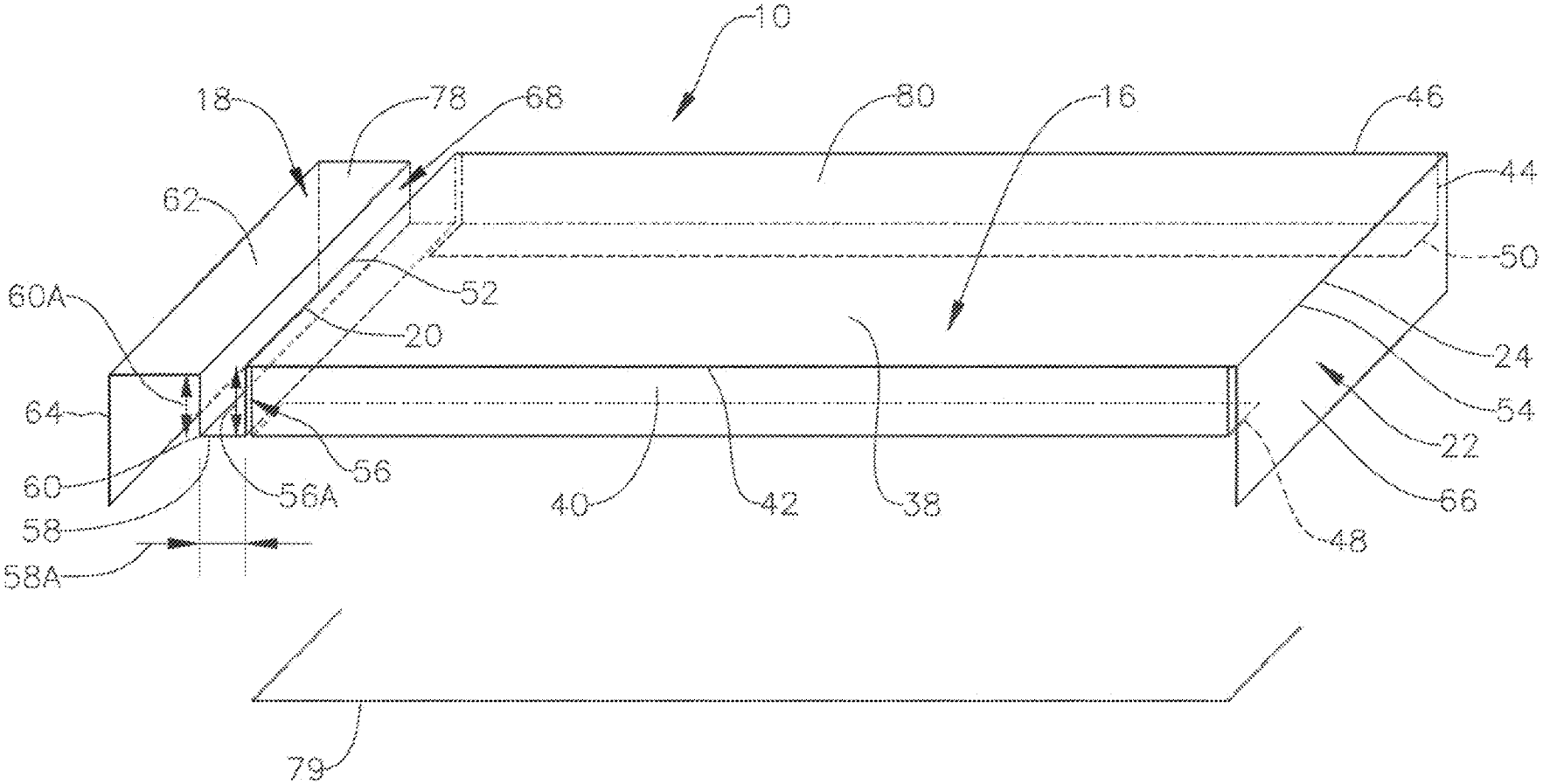
FIG. 2 is a perspective view of an example embodiment backing panel.

A backing panel 10 is mounted between adjacent studs 12,14 and forms a surface 72 for mounting a wall-defining board 73, such as drywall, as for example shown in FIG. 1B. A typical backing panel 10 includes a main body 16, a first stud interfacing portion 18 extending from a first end 20 of the main body and a second stud interfacing portion 22 extending from a second end 24 of the main body opposite the first end, as for example shown in FIG. 2. In an example embodiment, the backing panel is a unitary structure in that the body and end portions are integrally formed from a single sheet of material.

Studs are well known in the art. They have a web 25, as for example shown in FIGS. 1A and 1B. From opposite ends 26, 28 of the web extend legs 30, 32 in the same direction defining a channel. A lip 34, 36 extends from each leg in a direction generally parallel to the web, such that a first lip 34 extends from a first leg 30 of the legs toward a second leg 32 of the legs and a second lip 36 extends from the second leg 32 in a direction toward the first leg 30.

The backing panel main body 16 includes a web 38, a first leg 40 extending from a first end 42 of the web and second leg 44 extending from a second end 46 of the web in the same direction as the first leg. A first lip 48 extends from the first leg 40 in a direction toward the second leg 44. A second lip 50 extends from the second leg 44 in a direction toward the first leg 40. The first and second lips are optional and provide greater strength against bending and buckling of the backing panel.

The backing panel main body web 38 also has a third end 52 (defining the first end 20 of the main body) extending between and the first and second ends 42, 46. A fourth end 54 (defining the second end 24 of the main body) opposite the third end, also extends between the first and second ends of the main body web.

The first stud interfacing portion 18 extends from the third end 52. In an example embodiment, the first stud interfacing portion is designed for nesting within a stud. Such a first stud interfacing portion includes a third leg 56 extending a third distance 56A from the web third end in the direction of extension of the first and second legs. A fourth leg 58 extends distally, and preferably perpendicularly, from the third leg for a fourth distance 58A in a direction away from the web. A fifth leg 60 extends distally a fifth distance 60A, and preferably perpendicularly, from the fourth leg for a fourth distance in a direction opposite the direction of extension of the third leg and parallel to the third leg. A sixth leg 62 extends distally and preferably perpendicularly from the fifth leg for a sixth distance in the same direction as the fourth leg, parallel to the web and spaced apart from the fourth leg. A seventh leg 64 extends perpendicularly distally from the sixth leg in the direction of extension of the third leg and parallel to the third leg. A recess 68 is defined and bounded by the third, fourth and fifth legs.

An eight leg 66 defines the second stud interfacing portion and extends perpendicularly from the web fourth end in the direction of extension of the seventh leg and parallel to the seventh leg. In an example embodiment the eighth leg 66 extends at an angle 67 relative to the web that is a few degrees greater than perpendicular. In an example embodiment, the angle 67 is in the range of 91 to 93 degrees. In another example embodiment, the angle 67 is 92 degrees. By extending by slightly more than 90 degrees from the web, the eighth leg 66 exerts a slight force against the second stud for keeping the backing panel in position prior to fastening to the studs.

The studs typically extend parallel to each other with their first legs 30 extending axially and defining outer surfaces 70 for receiving q wall-defining board. The backing panel 10 is mounted on two adjacent studs with the first stud interfacing portion nested to a first stud and the second stud interfacing portion mounted to the second stud such that an outer surface 72 of the web of the main body of the backing panel is flush or coplanar with the outer surfaces 70 of the first legs 30 of the first and second studs. When the first stud interfacing portion is nested with the first stud, the first lip 34 of the first stud 12 is received in the recess 68 of the backing panel such that the sixth leg 62 is adjacent an interior surface of the first leg 30 of the first stud, and the seventh leg 64 of the backing panel is adjacent an inner surface the web 25 of the first stud, as for example shown if FIG. 1A. The second stud interfacing portion 22, i.e., the eighth leg 66, extends over an outer surface of the web 25 of the second stud 14. The sixth leg of the backing panel may be connected to the first leg of the first stud and/or the seventh leg may be connected to the web of the first stud. The connections in an example embodiment are accomplished using fasteners. Moreover, in an example embodiment, only seventh leg is fastened to the web of the first stud so that there no protruding fasteners through the first leg of the first stud. The eighth leg of the backing panel is connected, as for example by fasteners to the web of the second stud. In the example embodiment where the eighth leg extends from the backing panel web at an angle greater than 90 degrees, the eighth leg exerts a spring force against the web 25 of the second stud for keeping the backing panel in position prior to fastening to the studs. As stated, when mounted to the two studs, the outer surface 72 of the web of the backing panel is flush or co-planar with the outer surfaces 70 of the first legs 30 of the first and second studs. To accomplish this, the outer surface 78 the sixth leg 62 is offset relative to the outer surface 80 of the web 38 of the backing panel. Specifically, as measured from a plane 79 below and parallel the outer surface 78 of the sixth leg 62 and the outer surface 80 of the web 38 of the backing panel, the outer surface of the sixth leg of the backing panel is closer to the plane 79 than the outer surface of the web of the backing panel by an amount equal to the thickness of the first leg 30 of the first stud, as for example shown in FIG. 2. In this regard when the outer surface 78 of the sixth leg engages the inner surface of the first leg of the first stud, the outer surface 80 of the web of the backing panel is flush or co-planar with the first leg of the first stud.

In an example embodiment, where third leg 56 is perpendicular to the web 38 of the backing panel, the fourth leg 58 is perpendicular to the third leg 56, the fifth leg 60 is perpendicular to the fourth leg 58 and the sixth leg 62 is perpendicular to the fifth leg 58, the offset between the outer surface of the sixth leg and the web of the backing panel, may be accomplished by making the fifth distance 60A shorter than the third distance 56A by the thickness of the first leg of the first stud.

In another example embodiment, the first lip 34 of the first stud 12 may extend perpendicularly a distance from the first leg 30 of the first stud such that it engages the fourth leg of the backing panel when the outer surface of the first leg 30 of the first stud is flush or coplanar with the outer surface 72 of the web of the backing panel.

Figure 3A:
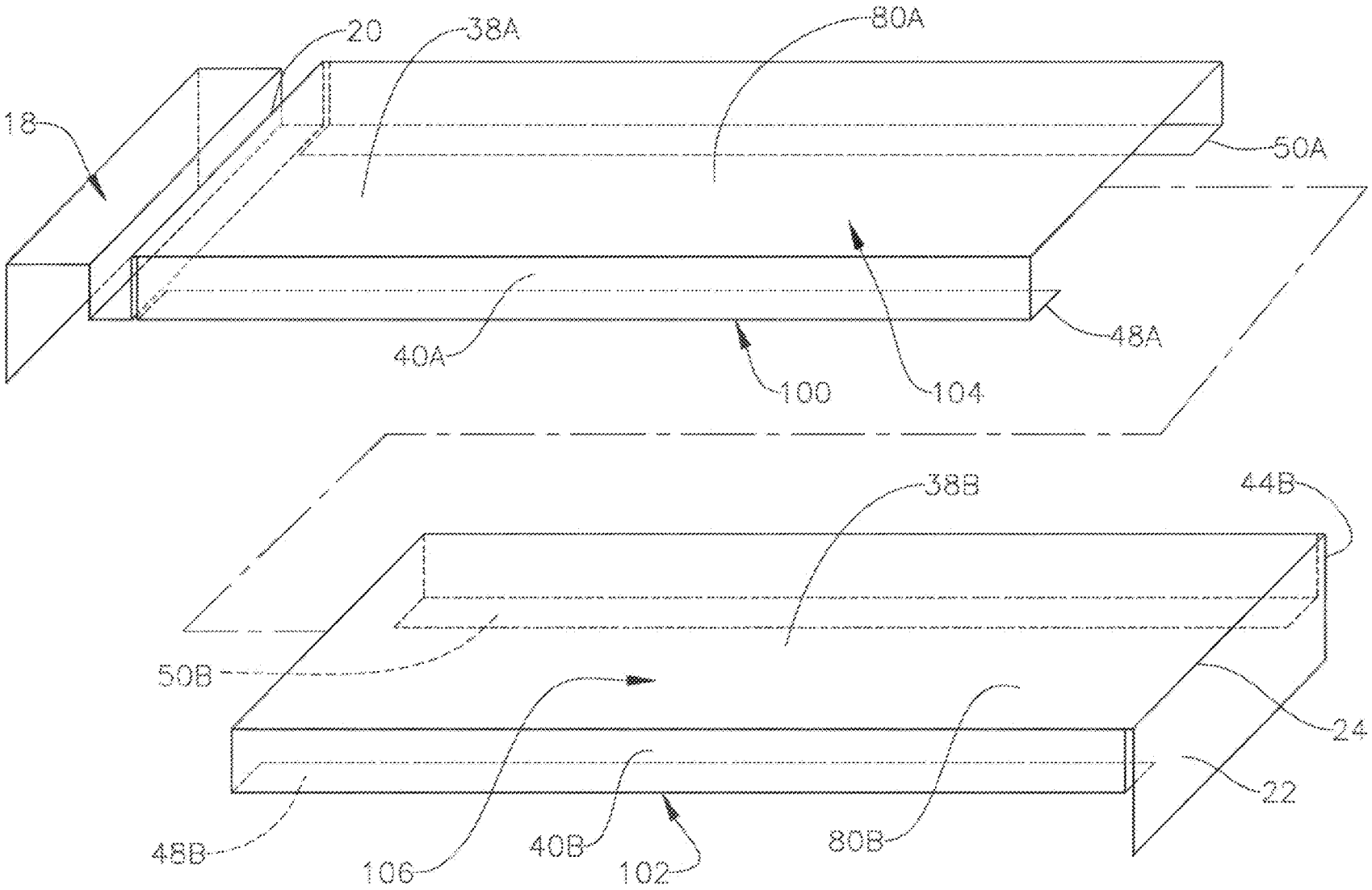
FIG. 3A is a perspective exploded view of an example embodiment two-section backing panel.
Figure 3B:
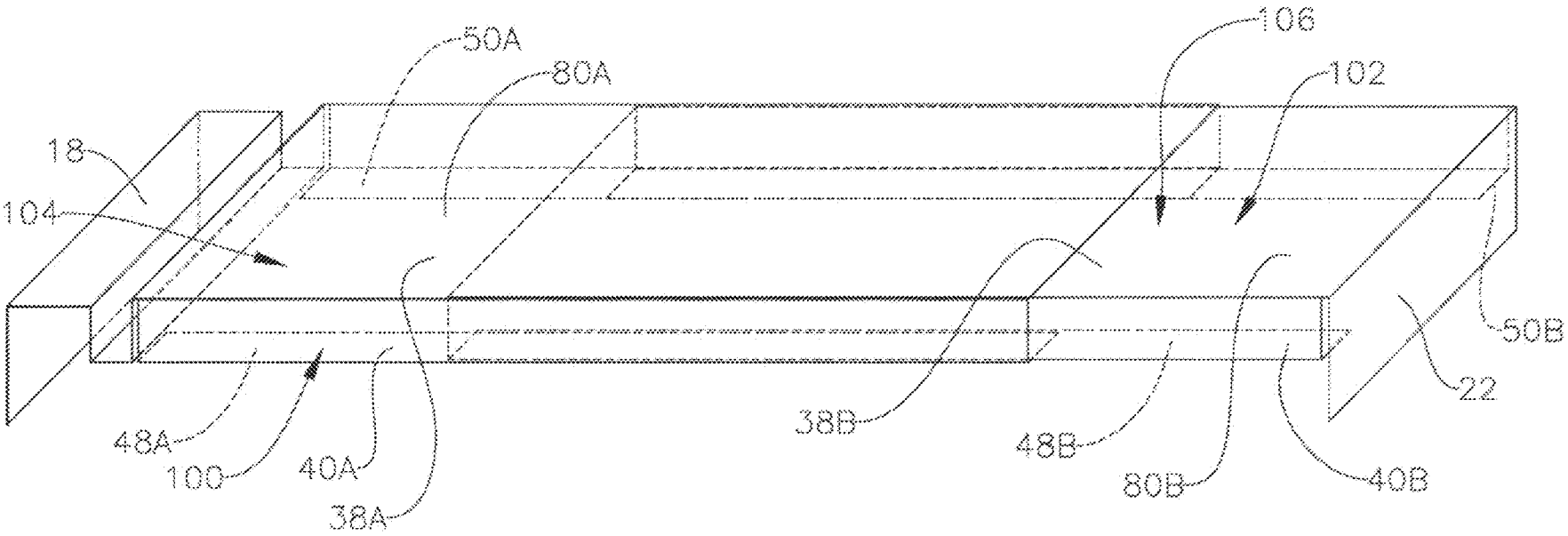
FIG. 3B is a perspective assembled view of the example embodiment two-section backing panel shown in FIG. 3A.

In a further example embodiment, the backing panel may be formed in two sections 100, 102, as for example shown in FIGS. 3A and 3B. The first section 100 includes a first portion 104 of the main body and the first stud interfacing portion 18, and the second section 102 includes a second portion 106 of the main body and the second stud interfacing portion 22. The second portion 106 of the main body is sized to be received between the web 38A and first and second lips 48A, 50A extending from the first legs 40A, 44A of the first portion of the main body, as shown in FIGS. 3A and 3B. Alternatively, the first portion of the main body is sized to be received between the web 38B and first and second lips 48B, 50B extending from the first and second legs 40B, 44B of the second portion of the main body. In this regard the spacing between the first and second stud interface portions 18, 22 can be adjusted, by sliding the first portion relative to the second portion, to accommodate different spacings between adjacent studs.

Figure 4A:
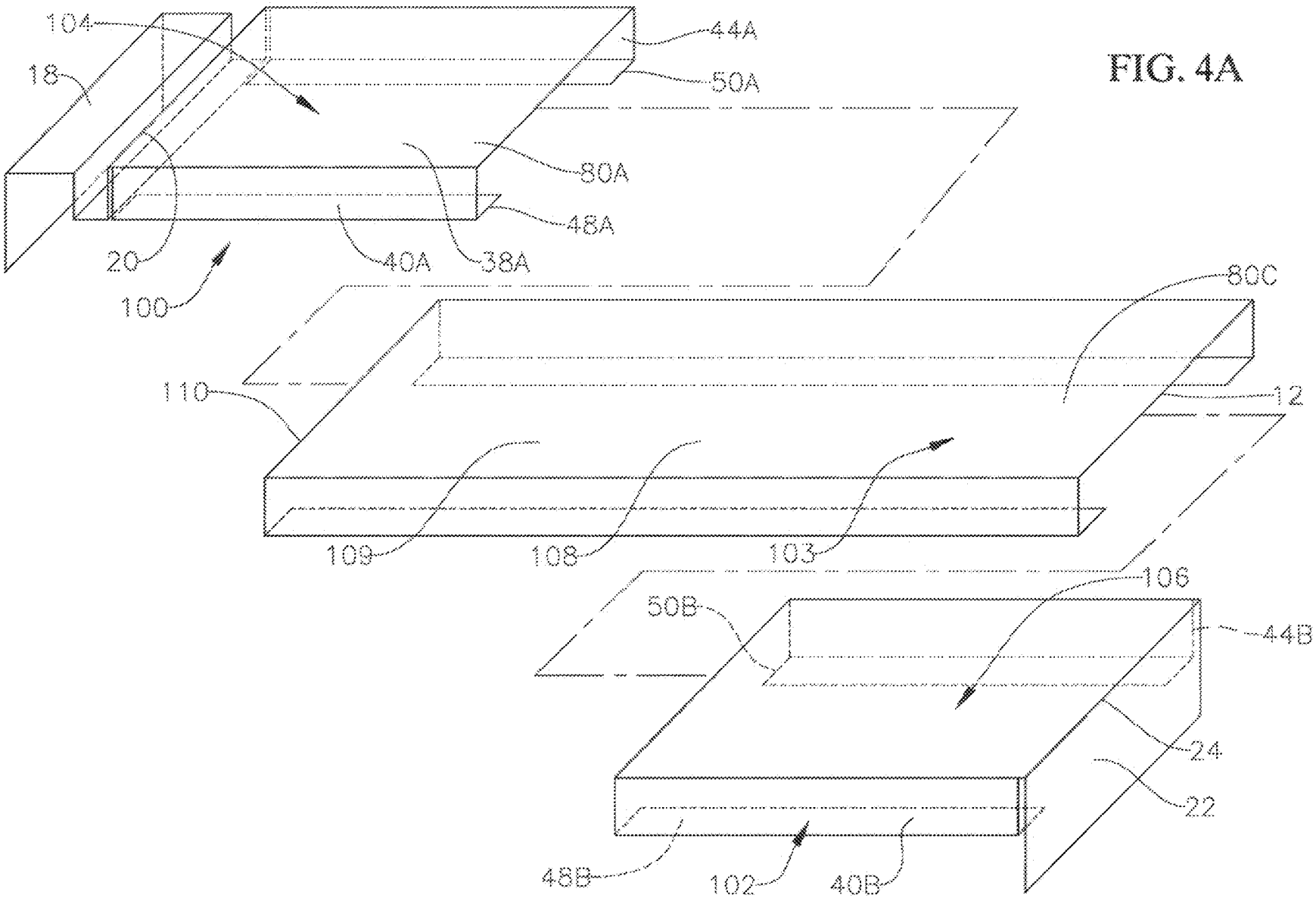
FIG. 4A is a perspective exploded view of another example embodiment three-section backing panel.
Figure 4B:
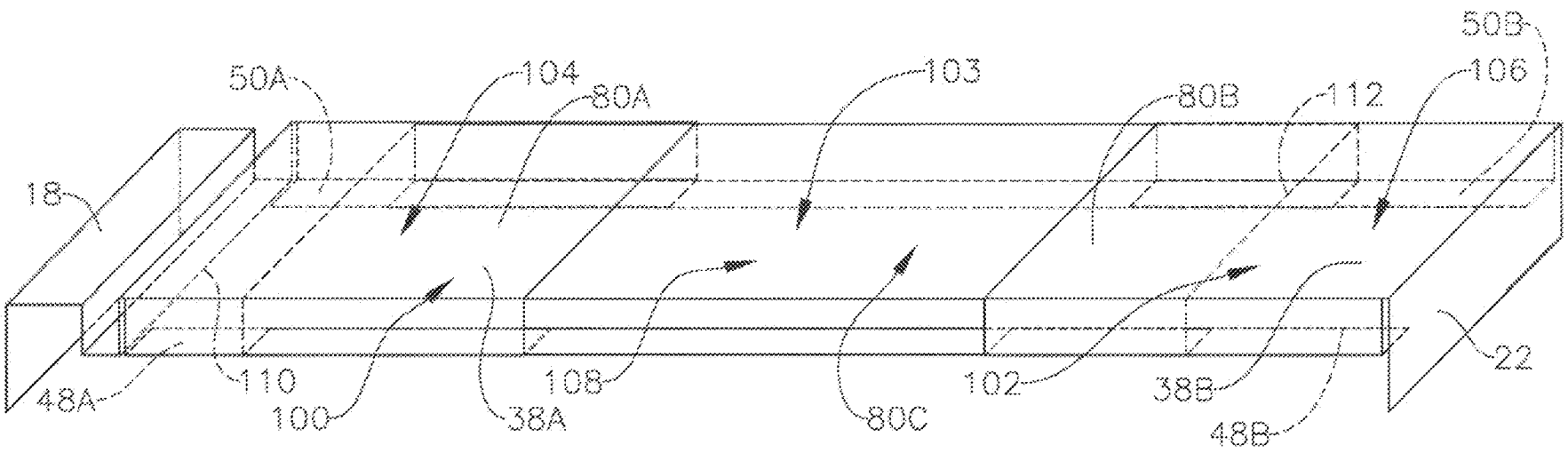
FIG. 4B is a perspective assembled view of the example embodiment three-section backing panel shown in FIG. 4A.

In yet a further example embodiment as for example shown in FIGS. 4A and 4B, the backing panel may be formed to have a first section 100, a second section 102, and a third section 103. The first and second sections are in one example embodiment the same as described in relation to FIG. 3A. However, with this embodiment, the first or second portion of the main body is not designed to be received within the web and lips of the other of the first or second portion of the main body. Rather, the third section 103 defines a third portion 108 of the main body that has a first end 110 that is sized to be received between the web 38A and first and second lips 48A, 50A of the first portion of the main body, and a second end 112 that is sized to be received between the web 38B and first and second lips 48B, 50B of the second portion of the main body, as for example shown in FIG. 4B. In this regard when mounted on adjacent studs, the outer surface 80A of the web 38A of the first section, the outer surface 80B of the web 38B of the second section, remains flush or coplanar with the first legs of the adjacent studs.

In another example embodiment, a third section 103 may be made to slid over the web 38A and first and second lips 48A, 50A of the first portion of the main body, and over the web 38B and first and second lips 48B, 50B of the second portion of the main body. With this embodiment, the section that is received within other sections does not need to have the lips. With this example embodiment, the distances of the surfaces 80A and 80B are set at a height as measured from plane 79, such that when the third section is slid over the first and second portions, the outer surface 109 of the third portion is flush or coplanar with the outer surfaces 70 of the first legs of the studs.

Figure 5:
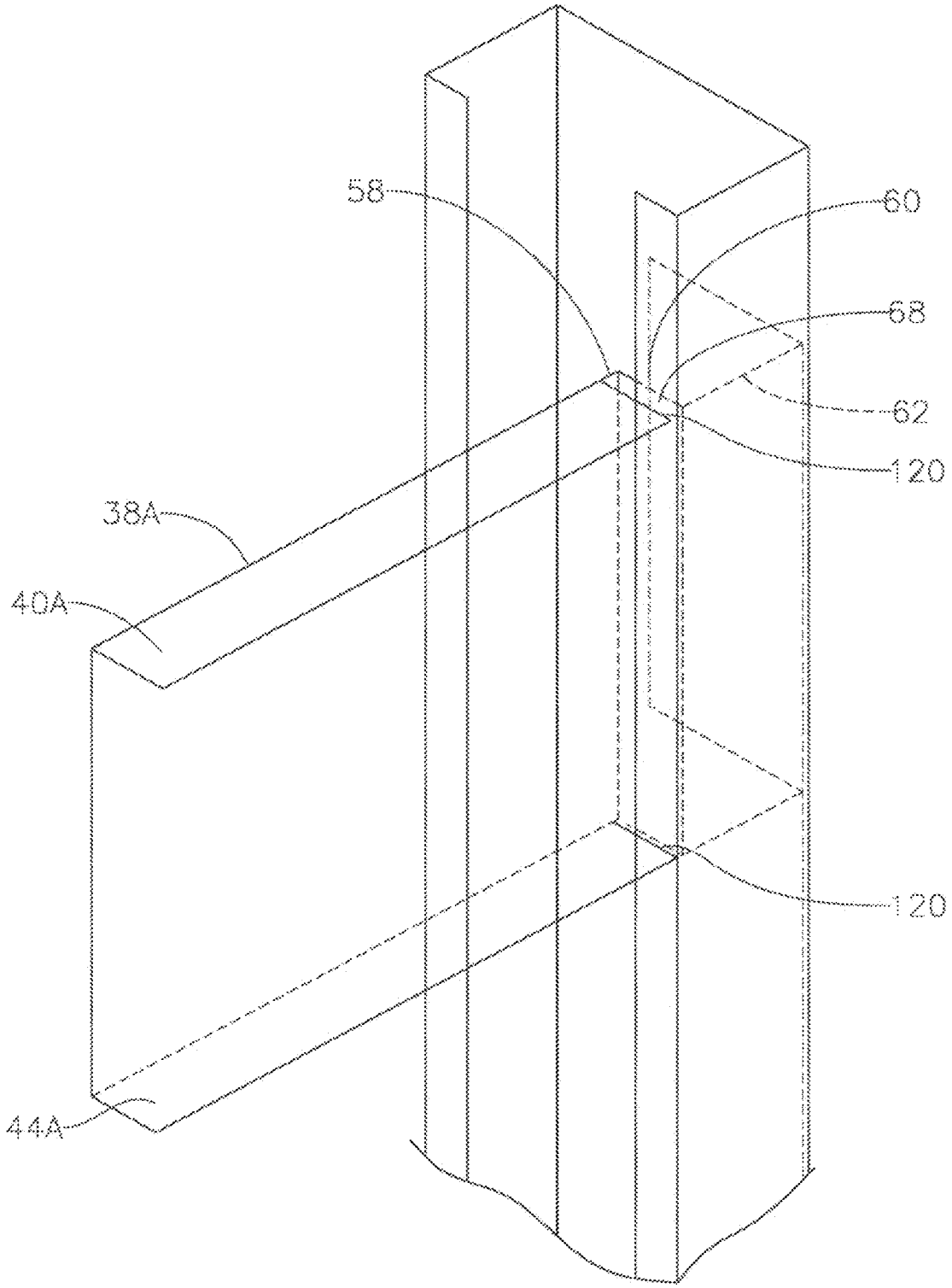
FIG. 5 is a perspective view of a third section of a multi section example embodiment backing panel.

In yet another example embodiment, the first portion of the main body and/or the second portion of the main body from which extend the first stud interfacing portion 18 is/are "upside down" in that the webs 38A, 38B extend to define the fourth leg 58, and offset from the sixth leg 62 of the first stud interfacing portion of any of the aforementioned example embodiment backing panels, as for example shown in FIG. 5. With this example embodiment, the recess 68 that receives the first lip 34 of the first stud 12 is defined between edges 120 of the first leg 40A and the fifth leg 60. With this embodiment, there is no third leg 56. Further example embodiment multi-section backing panels where at least a portion of the main body of any section is "upside down" are shown in FIGS. 6A, 6B, 6C, 7A, 7B, 7C, 8A, 8B, 8C, 9A, 9B, and 9C.

With any of the aforementioned example embodiments incorporating multiple sections where at least one portion of the main body is received in another portion, as for example shown in FIGS. 3, 4, 6A, 6B, 6C, 7A, 7B, 7C, 8A, 8B, 8C, 9A, 9B, and 9C the relative sizing of the two such portions is selected so as to minimize or alleviate play between two such portions perpendicular to the axis of expansion and contraction of one portion relative to the other portion. Moreover, in an example embodiment, each section is a unitary structure that is formed from a single sheet of material. Similarly with the second stud interfacing portion 22 (e.g., the eighth leg 66) may extend in a direction as shown in FIG. 7A which is opposite the direction shown in FIG. 3A. In the example embodiment shown in FIG. 7A, lips 48B 50B are not provided.

Figure 6A:
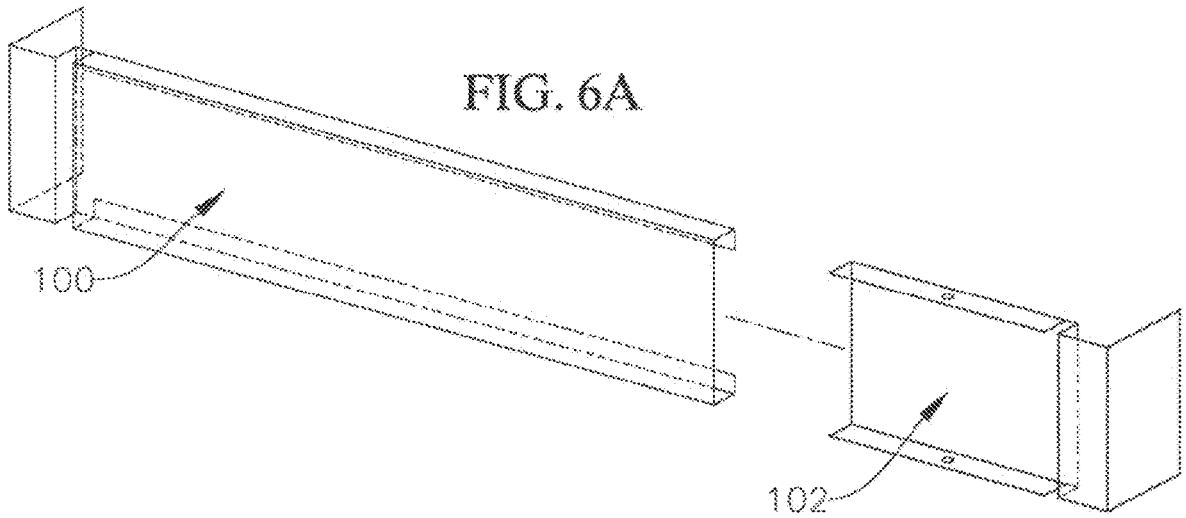
FIG. 6A is an exploded view of another example embodiment two-section backing panel.
Figure 6B:
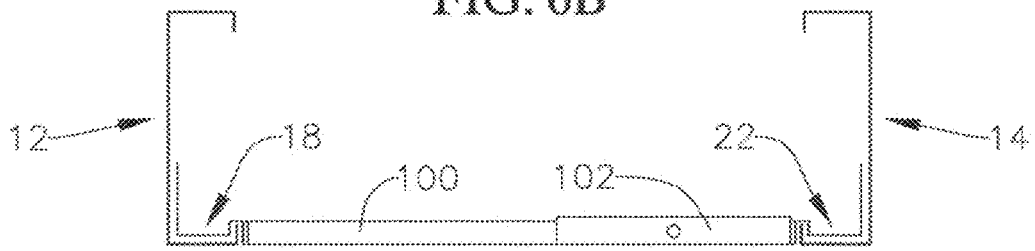
FIG. 6B is an end view of the example embodiment two-section backing panel shown in FIG. 6A mounted on two studs.
Figure 6C:
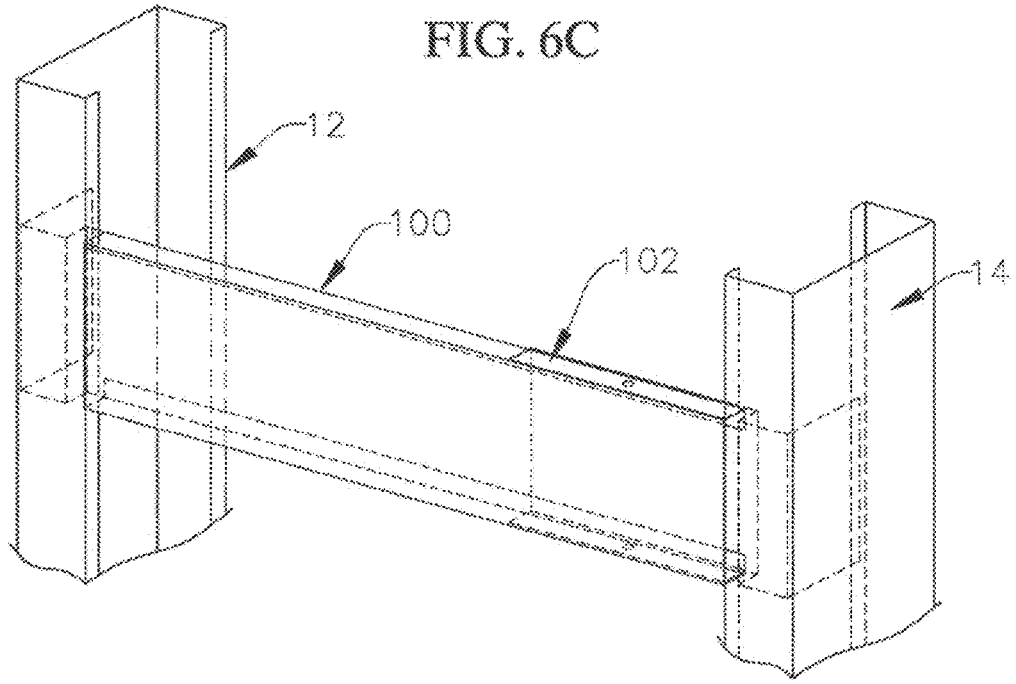
FIG. 6C is a perspective view of the example embodiment two-section backing panel shown in FIG. 6A mounted on two studs.
Figure 7A:
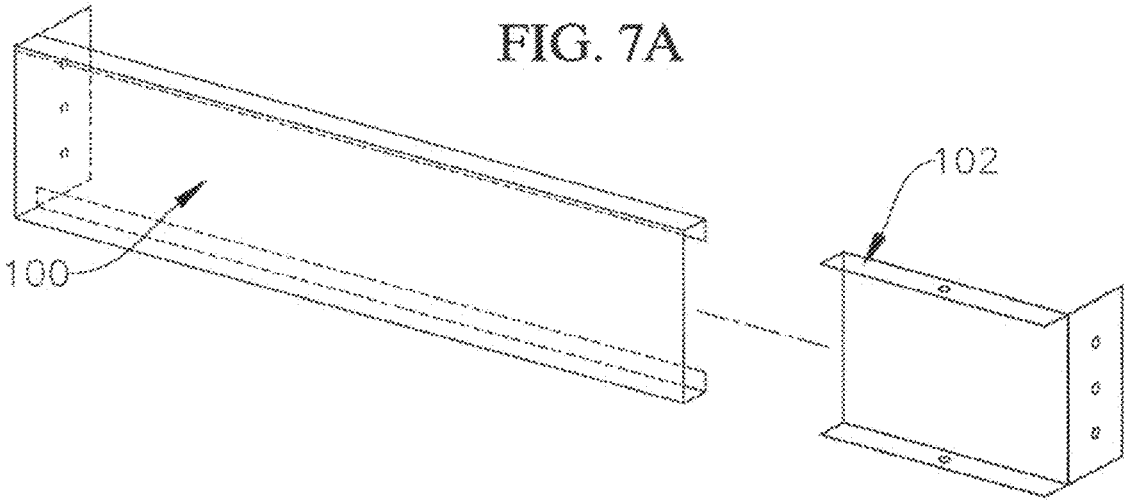
FIG. 7A is an exploded view of yet another example embodiment two-section backing panel.
Figure 7B:
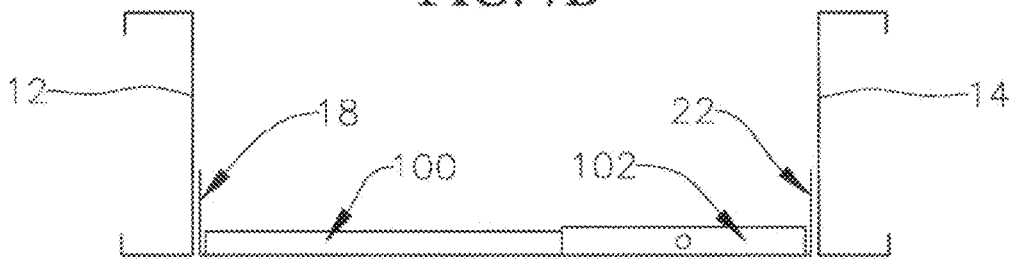
FIG. 7B is an end view of the example embodiment two-section backing panel shown in FIG. 7A mounted on two studs.
Figure 7C:
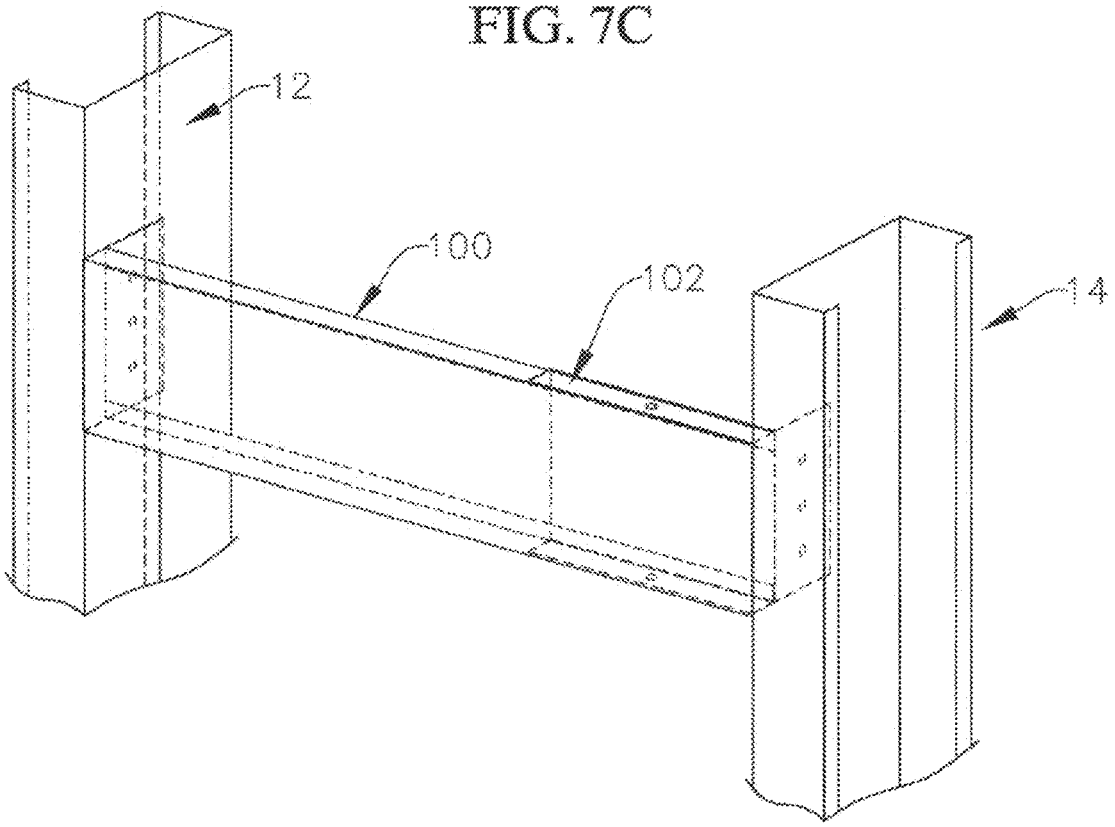
FIG. 7C is a perspective view of the example embodiment two-section backing panel shown in FIG. 7A mounted on two studs.
Figure 8A:
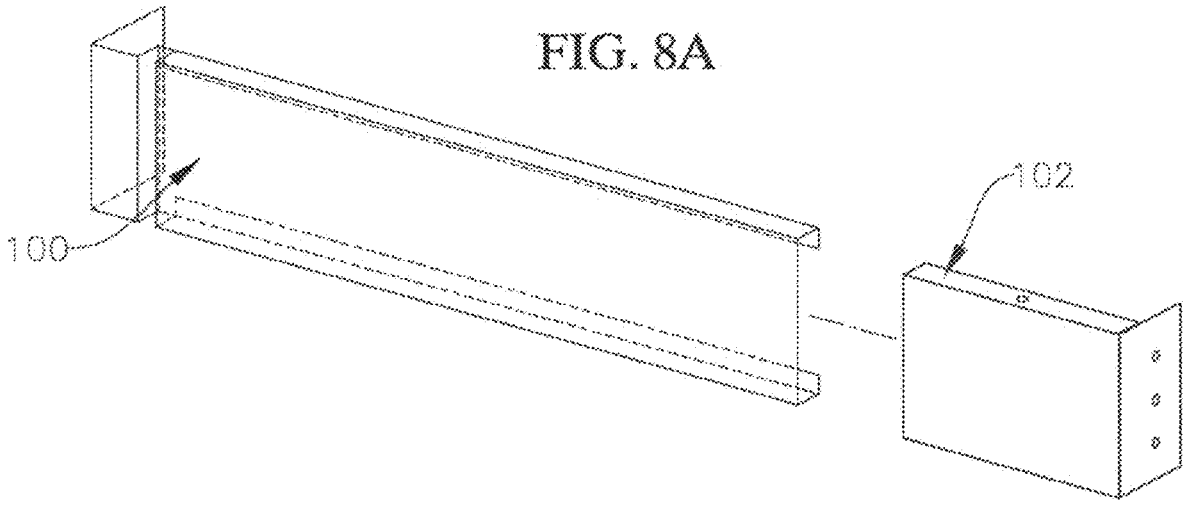
FIG. 8A is an exploded view of a further example embodiment two-section backing panel.
Figure 8B:
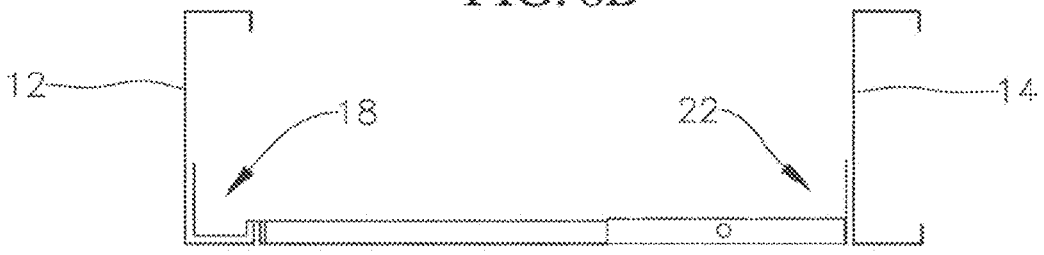
FIG. 8B is an end view of the example embodiment two-section backing panel shown in FIG. 8A mounted on two studs.
Figure 8C:
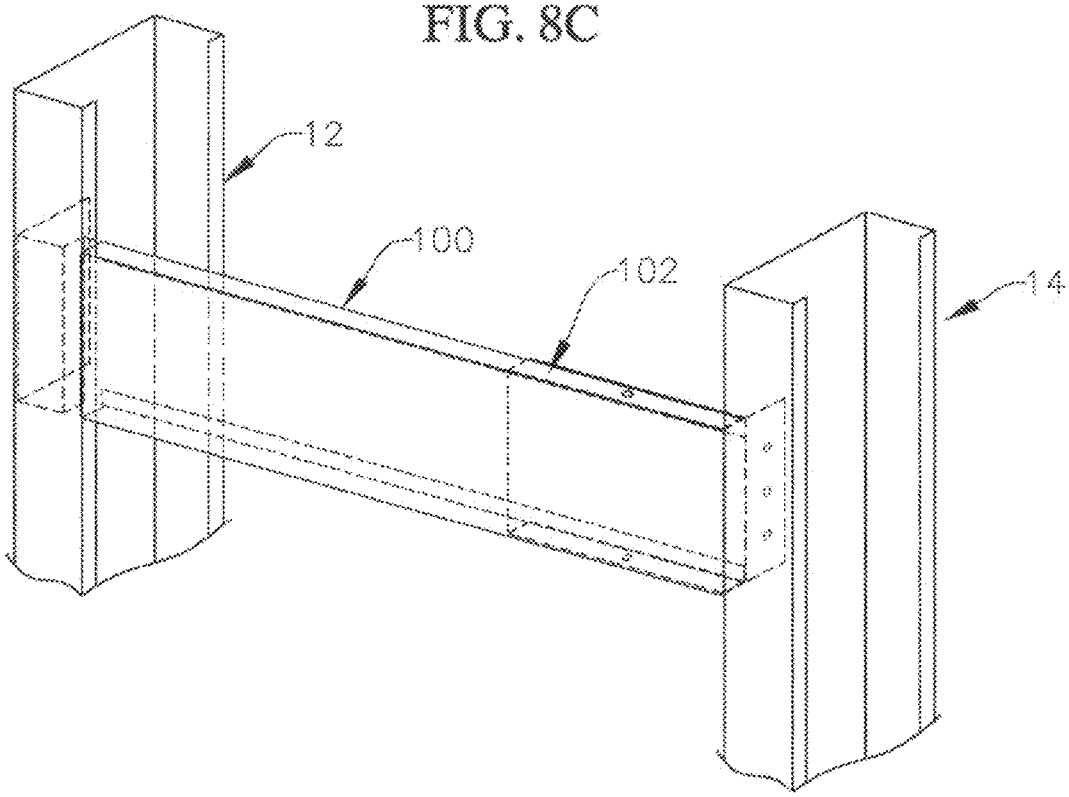
FIG. 8C is a perspective view of the example embodiment two-section backing panel shown in FIG. 8A mounted on two studs.
Figure 9A:
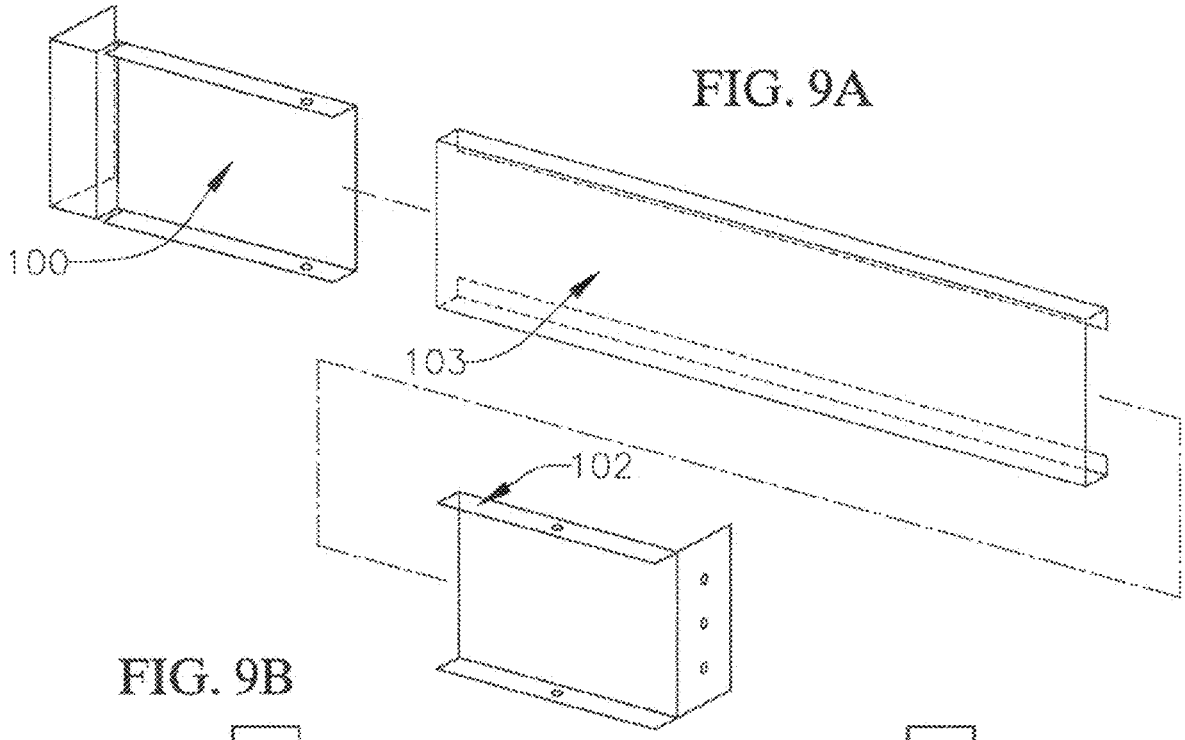
FIG. 9A is an exploded view of another example embodiment three-section backing panel.
Figure 9B:
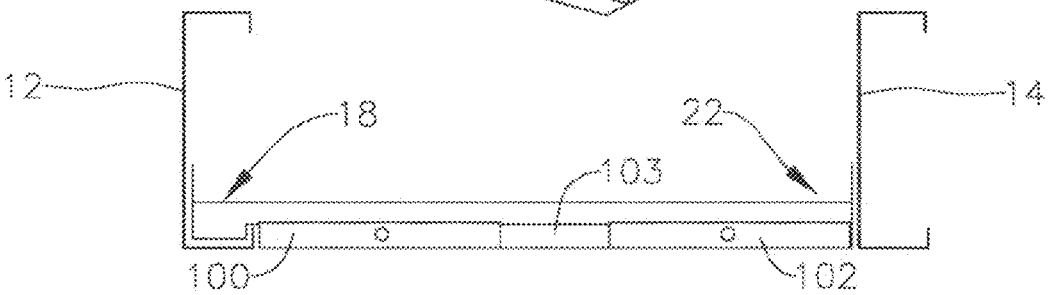
FIG. 9B is an end view of the example embodiment three-section backing panel shown in FIG. 9A mounted on two studs.
Figure 9C:
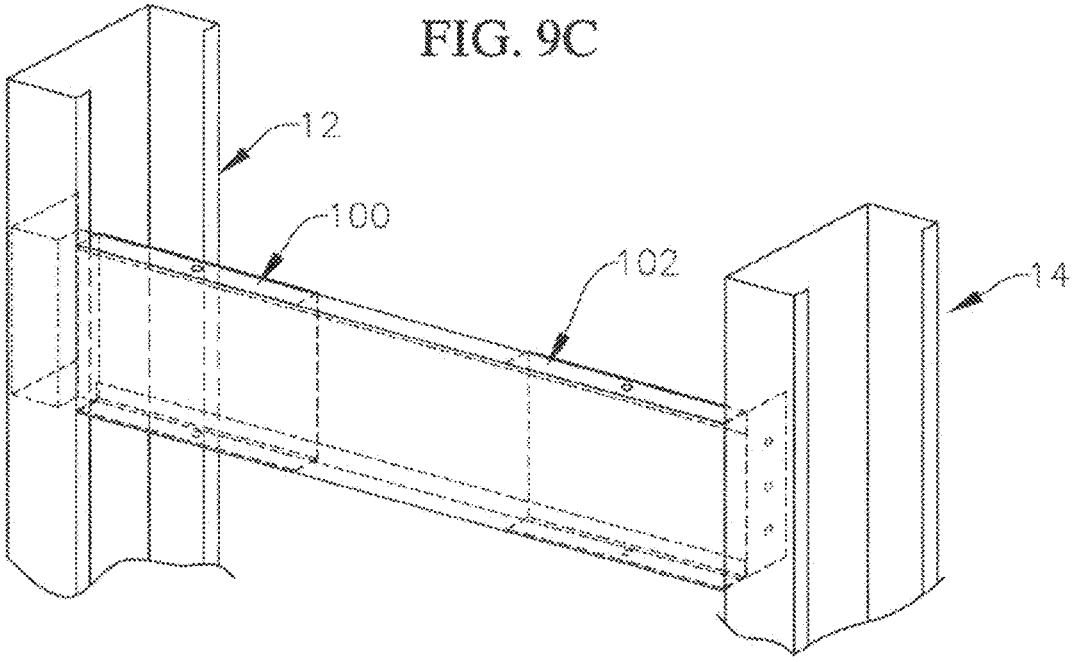
FIG. 9C is a perspective view of the example embodiment three-section backing panel shown in FIG. 9A mounted on two studs.

Any of the aforementioned embodiments, may be formed to have a second stud interface portion that is the same as the first stud interface portion so as to be able to be mounted to adjacent studs where the inner surface of each of the stud webs face each other, as for example shown in FIGS. 6A and 6B and in FIGS. 7A and 7B. With the embodiment shown in FIGS. 6A and 6B, a first stud interface portion 18 extends from the opposite ends 20, 24 of the main body or main body first and second portions 104, 106. With the embodiment shown in FIGS. 7A and 7B, a second stud interface portion 22 extends from the opposite ends 20, 24 of the main body or main body first and second portions 104, 106.

After the backing panel is installed on the two studs, the wall defining board, such as a drywall is mounted onto the first legs of the first and second studs and on the web of the backing panel which are all flush or coplanar.

Applicants have discovered that the lateral strength of the backing panel transverse to the plane of the web of the backing panel main body, and especially in a direction from the inner surface toward the outer surface of the web, is increased when the third leg is perpendicular to the web of the main body, the fourth leg is perpendicular to the third leg, the fifth leg is perpendicular to the fourth leg and the sixth leg is perpendicular to the fifth leg.

In an example embodiment, any of the aforementioned example embodiment backing panels is formed from metal.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," and similar terms have been used herein to describe a spatial relationship of one element to another, it is understood that these terms are intended to encompass different orientations of the various elements and components of the invention in addition to the orientation depicted in the figures. Additionally, as used herein, the term "substantially," "about," and similar terms are used as terms of approximation and not as terms of degree, and are intended to account for the inherent deviations in measured or calculated values that would be recognized by those of ordinary skill in the art. Furthermore, as used herein, when a component is referred to as being "on" another component, it can be directly on the other component or components may also be present therebetween. Moreover, when a component is component is referred to as being "coupled" to another component, it can be directly attached to the other component or intervening components may be present therebetween.

What is claimed is:

1. A backing panel comprising:

a main body comprising a web;

a first stud interfacing portion extending from one end of the main body for nesting within a first stud, comprising, a first leg extending coplanar from the web, a second leg extending distally and perpendicularly from the first leg, a third leg extending distally and perpendicularly from the second leg for being adjacent to a leg of the first stud, and a fourth leg extending distally and perpendicularly from the third leg for being adjacent to a web of the first stud; and a second stud interfacing portion extending from an opposite end of the main body for coupling with a second stud, wherein when nesting within the first stud a portion of the first stud will extend over said first leg along a direction transverse to said first leg, wherein at least a portion of the second, third and fourth legs are nested within the first stud.

2. The backing panel as recited in claim 1, wherein an outer surface of the web is parallel to an outer surface of the third leg, and wherein the outer surface of the third leg is offset from the outer surface of the web by a predetermined distance.

3. The backing panel as recited in claim 1, wherein the main body comprises a first portion that is slidably coupled to a second portion, wherein the first stud interfacing portion extends from the first portion of the main body and wherein the second stud interfacing portions extends from the second portion of the main body.

4. The backing panel as recited in claim 3, wherein one of the first and second portions of the main body is received within the other of the first and second portions of the main body, wherein said other of said first and second portions of the main body retains said one of said first and second portions of the main body laterally in relation to a direction of sliding of said first and second portions of the main body relative to each other.

5. The backing panel as recited in claim 3, wherein the main body comprises a third portion coupling said first portion of the main body to said second portion of the main body by being slidably coupled to at least one of the first portion and the second portion of the main body.

6. The backing panel a recited in claim 5, wherein the first portion of the main body comprises a first portion of an outer surface of the web, wherein the second portion of the main body comprises a second portion of the outer surface of the web, and wherein the first portion and the second portion of the outer surface of the web are coplanar.

7. The backing panel as recited in claim 6, wherein the third portion is received within the first portion and within the second portion of the main body and is retained laterally relative to the direction of relative sliding between the first and second portions by said first and second portions.

8. The backing panel as recited in claim 1, wherein the second stud interfacing portion is a fifth leg extending perpendicularly from the web.

9. The backing panel as recited in claim 1, wherein the second stud interfacing portion is a fifth leg extending at an angle greater than 90 degrees from the web for exerting a force within the second stud.

10. The backing panel as recited in claim 1, wherein the second stud interfacing portion comprises:

a fifth leg extending perpendicularly from the web;

a sixth leg extending distally and perpendicularly from the fifth leg;

a seventh leg extending distally and perpendicularly from the sixth leg, wherein the fifth, sixth and seventh legs define a channel;

an eighth leg extending distally and perpendicularly from the seventh leg; and a ninth leg extending distally and perpendicularly from the eighth leg.

11. The backing panel as recited in claim 1, wherein when coupled to the first and second studs, an outer surface of the web is flush with an outer surface of one of said legs of the first stud and an outer surface of a leg of the second stud.

12. A backing panel comprising:

a main body comprising a web;

a first stud interfacing portion extending from one end of the main body for nesting within a first stud, comprising, a first leg extending coplanar from the web, a second leg extending distally and transversely from the first leg, a third leg extending distally and transversely from the second leg for being adjacent to a leg of the first stud, and a fourth leg extending distally and transversely from the third leg for being adjacent to a web of the first stud; and a second stud interfacing portion extending from an opposite end of the main body for coupling with a second stud, wherein when nesting within the first stud a portion of the first stud will extend over said first leg along a direction transverse to said first leg, wherein at least a portion of the second, third and fourth legs are nested within the first stud.

13. The backing panel as recited in claim 12, wherein the main body comprises a first portion that is slidably coupled to a second portion, wherein the first stud interfacing portion extends from the first portion of the main body and wherein the second stud interfacing portions extends from the second portion of the main body.

14. The backing panel as recited in claim 13, wherein one of the first and second portions of the main body is received within the other of the first and second portions of the main body, wherein said other of the said first and second portions of the main body, retains said one of said first and second portions of the main body laterally in relation to a direction of sliding of said first and second portions of the main body relative to each other.

15. The backing panel as recited in claim 13, wherein the main body comprises a third portion coupling said first portion of the main body to said second portion of the main body by being slidably coupled to at least one of the first portion and the second portion of the main body.

16. The backing panel a recited in claim 15, wherein the first portion of the main body comprises a first portion of an outer surface of the web, wherein the second portion of the main body comprises a second portion of the outer surface of the web, and wherein the first portion and the second portion of the outer surface of the main body web are coplanar.

17. The backing panel as recited in claim 16, wherein the third portion is received within the first portion and within the second portion of the main body and is retained laterally relative to the direction of relative sliding between the first and second portions by said first and second portions.

* * * * *